United States Patent [19]

Murphy

[11] 4,110,066

[45] Aug. 29, 1978

[54] FLOATING ILLUMINATING DEVICE

[75] Inventor: Philip Joseph Murphy, San Mateo, Calif.

[73] Assignee: Lancaster Colony Corporation, Columbus, Ohio

[21] Appl. No.: 772,381

[22] Filed: Feb. 28, 1977

[51] Int. Cl.[2] ..... F23D 3/24

[52] U.S. Cl. ..... 431/320; 431/125

[58] Field of Search ..... 431/298, 320, 321, 322, 431/323, 324, 125, 48.2

[56] References Cited

U.S. PATENT DOCUMENTS

| | | | |
|---|---|---|---|
| 94,295 | 8/1869 | Dew | 431/321 |
| 108,416 | 10/1870 | Washington | 431/321 |

FOREIGN PATENT DOCUMENTS

| | | | |
|---|---|---|---|
| 2,335,258 | 7/1972 | Fed. Rep. of Germany | 431/320 |
| 592,429 | 1/1934 | Fed. Rep. of Germany | 431/298 |

*Primary Examiner*—Edward G. Favors

*Attorney, Agent, or Firm*—Townsend and Townsend

[57] ABSTRACT

A floating illuminating device adapted to float upon a body of combustible oil. A wick supported on a wick-holder draws oil by capillary action and may be ignited to provide illumination. The wick-holder is formed with a central depending generally frusto-conical well portion surrounded by elongate buoyancy imparting cavities which are spaced a substantial distance from the wick so that they do not suffer heat distortion. Improved channel means allow the oil to flow into the well.

12 Claims, 5 Drawing Figures

FLOATING ILLUMINATING DEVICE

BACKGROUND OF THE INVENTION

This invention relates to buoyant illuminating devices, and more particularly concerns devices which float on the surface of a body of combustible oil and include an upstanding wick member.

Many devices are known which comprise buoyant wick-holders which may be floated on the surface of a body of combustible oil so that a wick supported on the holder draws oil by capillary action and may be ignited. Some of these devices are disclosed in the prior art, for example U.S. Pat. Nos. 405,736 and 2,246,346 use cork, paste board or the like as buoyant members, which are not only porous, but also are highly absorbant with respect to the oil in which they float. Inevitably, such wick-holders become saturated with oil and since their absorption is not uniform, they tend to tilt while floating, thereby tilting their wicks and resulting in an undesirable appearance. Ultimately such wick-holders may turn over and sink, or may even ignite the oil on which they float.

U.S. Pat. No. 397,011 discloses a wickless float or cup having a central upright tube integral therewith. The cup has appropriate shape and weight so that when the cup is floated on the surface of a body of oil, there is oil in the tube substantially flush with the upper edge of the tube. The upper part of the tube is heated until the oil commences to boil and catch fire, after which the apparatus itself maintains the heat and the oil continues to burn. This device is inherently more expensive because it must be made of metal.

Another buoyant illuminating device is disclosed in U.S. Pat. No. 3,183,688. This device comprises a thin walled body having a central well portion, a walled buoyancy imparting portion surrounding the well portion, and an annular hollow rib portion separating the buoyancy imparting portion from the well portion. An annular ring of oil within the hollow rib portion serves to insulate the well portion from the buoyancy imparting portion and to dissipate heat and thereby eliminate the possibility of heat distortion. The bottom wall of the well portion has openings for admitting oil into the well portion for impregnating a mounted wick.

British specification No. 1,380,358 discloses another floating wick-holder. A semi-cylindrical member which is molded or vacuum-formed has diametral crisscross channels. Oil flows over the channels to feed a wick supported in the area traversed by the channels. Airtight cavities provide buoyancy. Because the channels are relatively deep and crisscross the entire member this configuration has proven to be unstable. Further the cavities, particularly in the embodiment disclosing pie-shaped cavities, are not spaced sufficiently from the wick. When the wick is ignited the portions of the member which form the cavities tend to melt in areas near the wick. This usually causes at least one cavity to collapse and the wick-holder overturns. The area traversed by the channels where the wick is located is substantially flat and air bubbles may become trapped beneath this region prohibiting the wick-holder from floating levelly.

SUMMARY OF THE INVENTION

The present invention provides an improved illuminating device adapted to float upon a body of combustible oil. A wick supported on a wick-holder draws oil by capillary action and may be ignited to provide illumination. The wick-holder is a thin, formed, generally circular member. The wick-holder has a central, depending, generally frusto-conical well portion. The bottom wall of this well portion has a recess adapted to maintain a wick in an upright position. The frusto-conical well portion provides a number of advantages. Its tapered walls eliminate the collection of air bubbles which might otherwise serve to make the wick-holder unstable. The well portion is disposed further below the surface of the oil and specifically below the surrounding channel means. The well portion is thus further removed from the heat produced by the burning wick. In addition the frusto-conical well portion gives the member a slightly lower center of gravity which further adds to the stability of the floating wick-holder.

The wick-holder is formed with a plurality of annularly spaced, elongate, buoyancy imparting, segmental cavities. The cavities open to the underside of the member and surround the frusto-conical well portion. The cavities are spaced a substantial distance from the wick so that they do not suffer heat distortion when the wick is ignited. Further, the cavities are elongate and are oriented generally along the outer circumference of the member so that they present a wider face toward the ignited wick and are thereby better adapted to dissipate heat throughout the material.

The wick-holder is also formed with improved channel means which extend radially outward between the cavities from the outer edge of the well portion to the periphery of the member. A wick-holder with channel means according to the present invention has been found to be more stable than a wick-holder which has fully diametral channels. The cavities provide sufficient buoyancy to maintain the channels submerged in the oil upon which the holder is floated so that the oil may communicate and flow into the well portion.

Thus, an improved floating illuminating device is provided which remains level when floating and which does not suffer damage from heat distortion. The novel features which are believed to be characteristic of the invention, will be better understood from the following description considered in connection with the accompanying drawings. Preferred embodiments of the invention are illustrated by way of example. It is to be understood, however, that the drawings are for the purpose of illustration and description only and that they are not intended as a definition of the limits of the invention.

DESCRIPTION OF THE PREFERRED EMBODIMENTS

Figure 1:
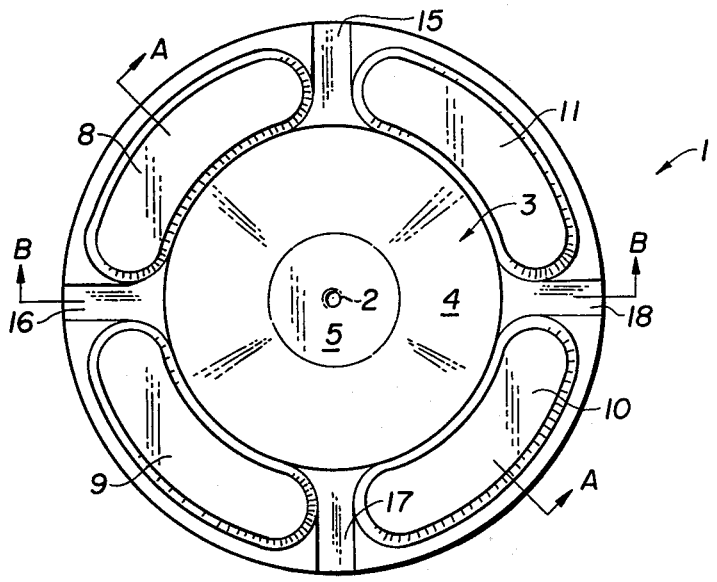
FIG. 1 is a plan view of the improved floating illuminating device of the present invention.

Referring now to FIG. 1 the illuminating device of the present invention comprises a wick-holder generally designated 1 and a wick 2 mounted in the center of the wick holder. Wick-holder 1 is a thin, formed, generally circular member which has a well portion generally designated 3. The wick-holder may be formed of an oil impervious material such as plastic which may be either opaque or transparent as desired. The well portion has an inclined wall portion 4 and a bottom wall or flat portion 5. Well portion 3 resembles a dish-like structure.

The well portion is surrounded by cavities or pockets 8–11. The cavities 8–11 are annularly spaced about well portion 3 and are spaced a substantial distance from wick 2, at least a distance equal to eight times the width of the wick.

Channel or conduit means 15–18 extend radially outward between adjacent cavities 8–11 from well portion 3 to the periphery of wick-holder 1.

Figure 2A:
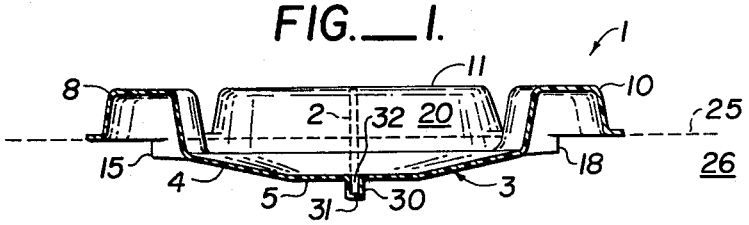
FIG. 2A is a sectional view of the device of FIG. 1 taken along lines A — A.

FIG. 2A is a sectional view of the device of FIG. 1 taken along lines A — A. Sectional portions of cavities 8 and 10 are depicted. The elongate shape of cavity 11 is shown. Cavity 11 presents a relatively wide face 20 toward wick 2. The dashed line 25 indicates the surface of the body of combustible fluid 26 upon which the present invention floats.

Figure 2B:
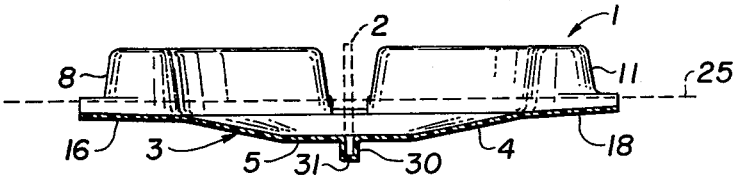
FIG. 2B is a sectional view of the device of FIG. 1 taken along lines B — B.

FIGS. 1, 2A and 2B show that well portion 3 depends from cavities 8–11 and has a generally frusto-conical shape consisting of inclined wall portion 4 and bottom wall 5. Tube 30 depends from bottom wall 5 and is closed at the lower end 31 thereof. Tube 30 defines a wick retaining recess 32.

In FIG. 2A channel means 15 and 18 lie submerged below surface 25 allowing combustible fluid to flow into well portion 3 and thereby impregnating wick 2. FIG. 2A also shows that cavities 8–11 open to the underside of the wick-holder 1. The air trapped within cavities 8–11 provides wick-holder 1 with sufficient buoyancy to maintain it in a floating condition atop the body of combustible fluid 26 with channel means 15 and 18 as well as channel means 16 and 17 submerged below surface 25.

FIG. 2B is a sectional view of the device of FIG. 1 taken along lines B — B. Cavities 8 and 11 are shown in their entirety. It may be seen that channel means 16 and 18 extend only from well portion 3 to the outer periphery of wick-holder 1 and do not extend across the entire diameter thereof.

Figure 3:
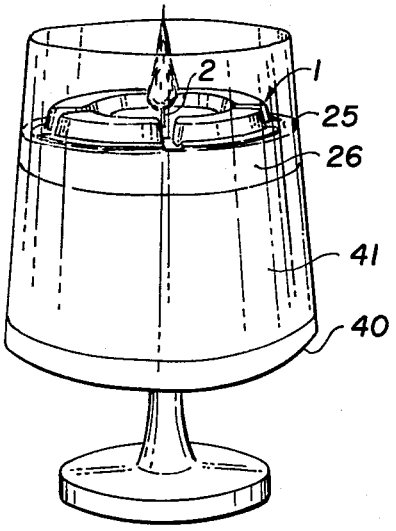
FIG. 3 is a perspective view of a glass filled with water and an overlying layer of combustible fluid whereon the device of FIG. 1 is floating with its wick ignited.

FIG. 3 is a perspective view of a glass 40 filled with a first layer of water 41. A layer of combustible fluid 26 rests on top of water 41. Wick-holder 1 floats on the surface 25 of fluid 26. Wick 2 is shown ignited. The conduit or channel means and the dish-like structure or well portion are submerged.

Figure 4:
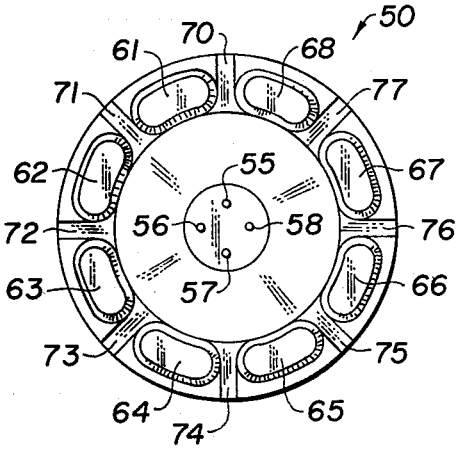
FIG. 4 is a plan view of an illuminating device according to the present invention which has a plurality of wicks.

FIG. 4 is a plan view of an illuminating device 50 according to the present invention which has a plurality of wicks 55–58. Device 50 has 8 cavities designated 61–68 and channel means 70–77 therebetween. Device 50 is similar in all other respects to the device of FIG. 1 except that it has been drawn to a smaller scale. A plurality of tubes depend from its bottom wall. These tubes are closed at their lower ends and define wick retaining recesses for wicks 55–58.

I claim:

1. An illuminating device of unitary construction comprising in combination a wick and a thin, formed member of oil impervious material for floating on a body of combustible fluid, the member comprising a central depending generally frusto-conical well portion and a plurality of annularly spaced elongate buoyancy imparting segmental cavities opening to the underside of the member and surrounding the well portion, channel means extending radially between the cavities from the outer edge of the well portion to the periphery of the member to allow combustible fluid to flow into the well portion, the well portion including a bottom wall with at least one wick retaining recess having the wick mounted therein in an upstanding position with the upper portion of the wick projecting above the bottom wall to allow the wick to become impregnated with combustible fluid, and wherein the cavities are spaced a substantial distance from the wick so that they do not suffer heat distortion when the wick is ignited.

2. An illuminating device according to claim 1 wherein the cavities are spaced from the wick at least a distance equal to eight times the width of the wick.

3. An illuminating device according to claim 1 wherein the oil impervious material is transparent.

4. An illuminating device according to claim 1 wherein the oil impervious material is opaque.

5. An illuminating device according to claim 1 wherein the bottom wall has a plurality of wick retaining recesses.

6. An illuminating device according to claim 1 wherein the wick retaining recess is defined within a tube which depends from the bottom wall and which is closed at the lower end thereof.

7. An illuminating device according to claim 1 wherein the bottom wall has a plurality of recesses defined within corresponding tubes which depend from the bottom wall and which are closed at their lower ends.

8. An illuminating device according to claim 1 wherein the cavities provide sufficient buoyancy to maintain the channels submerged in the combustible fluid.

9. A floating wick-holder comprising a thin generally circular sheet of material formed with a centrally located circular flat portion having an upper surface and a lower surface and a plurality of wick retaining recesses in its medial portion defined within corresponding tubes which depend from the lower surface of the flat portion and which are closed at their lower ends, a wall portion which inclines upwardly from the flat portion so that the flat portion and the wall portion form a dish-like structure, a plurality of conduit means spaced equally around and communicating between the periphery of the wick-holder and the upper surface of the dish-like structure, and a plurality of pockets which open to the underside of the wick-holder and which are separated by the conduit means and are adjacent the outer edge of the wall portion, the pockets being spaced a substantial distance from the wick retaining recess so that they do not suffer heat distortion when a wick is placed in the recess and ignited, and wherein the pockets provide sufficient buoyancy so that only the conduit means and the dish-like structure are submerged when the wick-holder is placed on the surface of a body of combustible fluid.

10. A wick-holder according to claim 9 wherein the material is oil impervious.

11. A wick-holder according to claim 10 wherein the material is transparent.

12. A wick-holder according to claim 10 wherein the material is opaque.

* * * * *